US005192610A

United States Patent [19]

Lorimer et al.

[11] Patent Number: 5,192,610

[45] Date of Patent: Mar. 9, 1993

[54] CORROSION-RESISTANT PROTECTIVE COATING ON ALUMINUM SUBSTRATE AND METHOD OF FORMING SAME

[75] Inventors: D'Arcy H. Lorimer, San Luis Obispo; Craig A. Bercaw, Hayward, both of Calif.

[73] Assignee: Applied Materials, Inc., Santa Clara, Calif.

[21] Appl. No.: 534,796

[22] Filed: Jun. 7, 1990

[51] Int. Cl.[5] ..... B32B 15/04; B32B 15/20

[52] U.S. Cl. ..... 428/33.6; 428/469; 428/472; 428/472.2; 428/701

[58] Field of Search ..... 428/469, 472, 472.2, 428/336, 701, 691; 427/255.1, 255.4, 38, 333, 343, 399, 419.2; 148/20.3, 276, 284, 285

[56] References Cited

U.S. PATENT DOCUMENTS

| | | | |
|---|---|---|---|
| 2,092,033 | 9/1937 | Stroup | 148/13.1 |
| 2,092,035 | 9/1937 | Stroup | 148/13.1 |
| 2,993,819 | 7/1961 | Nessim | 148/6.27 |
| 3,591,426 | 7/1971 | O'Donnell | 148/6.3 |
| 3,592,700 | 7/1971 | Toy | 148/6.3 |
| 3,961,111 | 6/1976 | Smith | 427/419 |
| 4,484,954 | 11/1984 | Tarancon | 148/6.3 |
| 4,647,347 | 3/1987 | Schoener et al. | 204/37.6 |
| 4,786,336 | 11/1988 | Schoener et al. | 148/6.27 |

*Primary Examiner*—Ellis P. Robinson
*Attorney, Agent, or Firm*—John P. Taylor

[57] ABSTRACT

A corrosion-resistant protective coating on an aluminum substrate capable of withstanding corrosion attack by process halogen gases and plasmas is disclosed. The protective coating is formed by contacting an aluminum oxide layer on an aluminum substrate with one or more fluorine-containing gases at an elevated temperature. In a preferred embodiment, a high purity corrosion-resistant protective coating on an aluminum substrate capable of withstanding corrosion attack may be formed by first forming a high purity aluminum oxide layer on the aluminum substrate and then contacting the aluminum oxide layer with one or more high purity fluorine-containing gases at an elevated temperature to form the high purity corrosion resistant protective coating thereon.

20 Claims, 1 Drawing Sheet

Figure 1
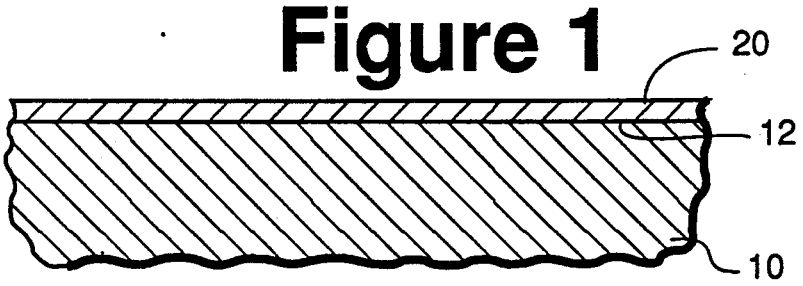
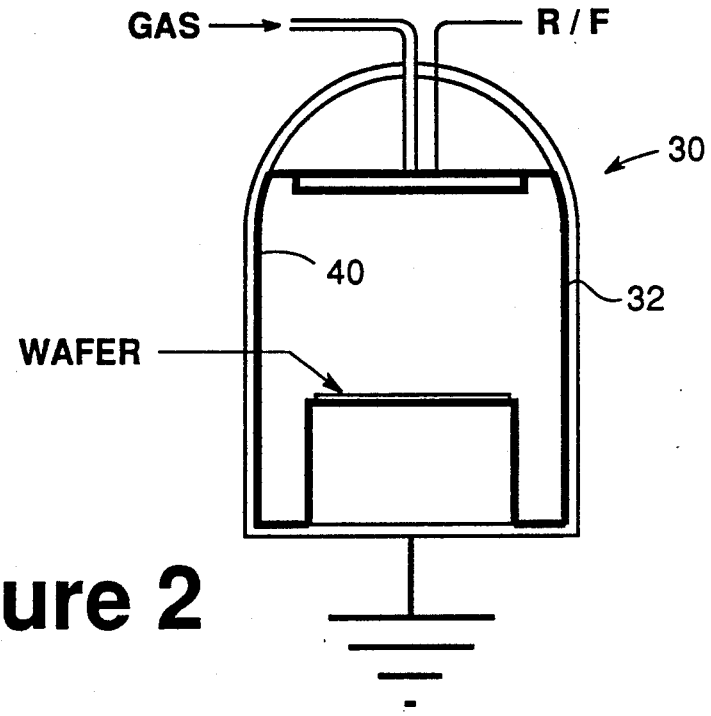
Figure 2
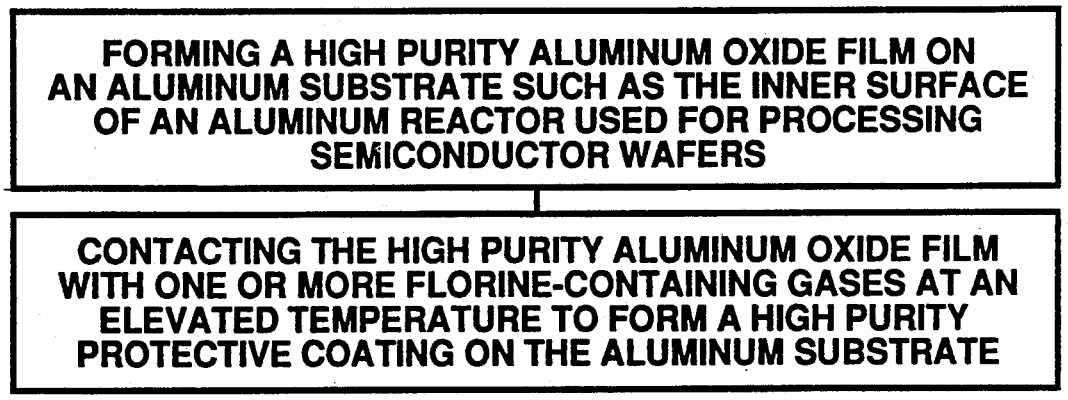
Figure 3

CORROSION-RESISTANT PROTECTIVE COATING ON ALUMINUM SUBSTRATE AND METHOD OF FORMING SAME

BACKGROUND OF THE INVENTION

1. Field of the Invention

This invention relates to a corrosion resistant protective coating formed on an aluminum substrate. In a particularly preferred embodiment, the invention relates to a high purity protective coating formed on an aluminum substrate by contacting a high purity aluminum oxide coating with one or more fluorine-containing gases to form a coated aluminum substrate capable for use in processing apparatus used to form integrated circuit structures on semi-conductor wafers.

2. Description of the Related Art

The chamber walls of processing apparatus used in the production of integrated circuit structures on semiconductor wafers such as, for example, chemical vapor deposition (CVD) chambers and/or etching chambers, e.g. reactive ion etching chambers, are subject to attack by the chemicals used in such deposition and etching processes.

In the past, the use of aluminum chambers in semiconductor wafer processing apparatus with anodized aluminum substrates on the inner walls of the chambers provided sufficient protection against such chemical attack, while permitting the utilization of a relatively inexpensive metal to construct the chamber or chambers of the processing apparatus. However, more recently, the integrated circuit chip industry has recognized the need for yet higher standards of purity in the processing equipment used to fabricate the integrated circuit structures. It has, therefore, been proposed, by Ohmi, in "Fluorine Passivation Technology of Metal Surface", 8th Symposium on ULSI Ultra-clean Technology", The Proceedings, Jan. 26–28, 1989, to replace the anodized aluminum chambers with highly polished stainless steel pretreated in HF to remove oxides, passivated with a high purity $F_2$ gas to form a non-stoichiometric iron fluoride, and then thermally treated to form an $FeF_2$ coating. While the resulting film withstands gaseous halogen-containing environments, it will corrode if exposed to an aqueous environment.

It has also been proposed by Ohmi, in "Outgas-Free Corrosion-Resistant Surface Passivation of Stainless Steel for Advanced ULSI Process Equipment", ECS Fall Meeting, Chicago, October, 1988 Symposium of Automated IC Manufacturing, to oxidize passivated highly polished stainless steel materials in $O_2$ to form a protective oxide surface thereon. Such surfaces are said to be capable of withstanding visible attack by concentrated aqueous hydrochloric acid, i.e., without any visible evidence of evolution of gas, for as long as 30 to 40 minutes.

While a coating with a resistance to corrosion for 30–40 minutes would not normally be considered sufficient for industrial use, it must be pointed out that exposure to aqueous concentrated mineral acids such as hydrochloric acid is considered to be a worst case test, indicative of much longer resistance to corrosion by gaseous halogens.

Therefore, the use of such highly polished stainless steel materials would apparently satisfy the corrosion resistance requirements of the integrated circuit chip industry. However, the cost of the use of such materials in the construction of processing equipment, such as deposition and etching chambers, is prohibitive.

For example, the substitution of an ordinary stainless steel material for aluminum in the construction of an etching or deposition chamber may result in a cost increase of about four times the cost of aluminum, while the use of a highly polished and air oxidized stainless steel may be as much as four times the cost of ordinary stainless steel; i.e., the substitution of such highly polished and specially processed stainless steels for conventional anodized aluminum can result in an increase of costs of over fifteen times what the cost would be to use aluminum.

It would, therefore, be desirable to provide an aluminum material having a corrosion-resistant protective coating on its surface which is capable of resisting the corrosive attack of process halogen gases and plasma (as measured by accelerated corrosion resistance tests using concentrated aqueous halogen acids). It would be even more desirable to provide a high purity corrosion-resistant protective coating which may be utilized on the surface of aluminum parts used in vacuum process chambers so that aluminum may continue to be utilized in the construction of semi-conductor wafer processing equipment for the integrated circuit chip industry without sacrificing purity standards.

SUMMARY OF THE INVENTION

It is, therefore, an object of this invention to provide, on an aluminum substrate, a corrosion-resistant protective coating capable of withstanding corrosion attack by process halogen gases and plasmas.

It is another object of this invention to provide, on an aluminum substrate, a corrosion-resistant protective coating comprising an aluminum oxide coating which has been contacted with one or more fluorine-containing gases to form a protective coating on the aluminum substrate capable of withstanding corrosion attack by process halogen gases and plasmas.

It is yet another object of this invention to provide an aluminum substrate having a high purity corrosion-resistant protective coating thereon capable of withstanding corrosion attack by process halogen gases and plasmas.

It is still another object of this invention to provide an aluminum substrate having a high purity aluminum oxide coating thereon which has been contacted with one or more fluorine-containing gases to form a high purity protective coating thereon capable of withstanding corrosion attack by process halogen gases and plasmas.

It is a further object of this invention to provide an aluminum vacuum chamber for semi-conductor wafer processing equipment having the inner aluminum surfaces of the chamber walls protected by a high purity aluminum oxide coating thereon which has been reacted with one or more fluorine-containing gases to form a high purity protective coating thereon capable of withstanding corrosion attack by process halogen gases and plasmas.

It is yet a further object of the invention to provide a method for forming on an aluminum substrate a corrosion-resistant protective coating of a fluorinated aluminum oxide capable of withstanding corrosion attack by process halogen gases and plasmas.

It is still a further object of the invention to provide a method for forming on an aluminum substrate a corrosion-resistant protective coating of a fluorinated aluminum oxide capable of withstanding corrosion attack by process halogen gases and plasmas which comprises forming an aluminum oxide coating on the aluminum substrate and then treating the aluminum oxide coating with one or more fluorine-containing gases to form the corrosion-resistant protective coating.

It is another object of the invention to provide a method for forming on an aluminum substrate a high purity corrosion-resistant protective coating of a fluorinated aluminum oxide capable of withstanding corrosion attack by process halogen gases and plasmas which comprises the steps of forming a high purity aluminum oxide coating on the aluminum substrate and then treating the aluminum oxide coating with one or more high purity fluorine-containing gases to form the high purity corrosion-resistant protective coating.

These and other objects of the invention will be apparent from the following description and accompanying drawings.

BRIEF DESCRIPTION OF THE DRAWINGS

FIG. 1 is a fragmentary cross-sectional view of an aluminum substrate having a corrosion-resistant protective coating formed on the surface of the substrate.

FIG. 2 is a fragmentary vertical cross-sectional view of an aluminum vacuum chamber for processing semiconductor wafers having a high purity protective coating formed on the inner aluminum surfaces of the chamber.

FIG. 3 is a flow sheet illustrating the process of the invention.

DETAILED DESCRIPTION OF THE INVENTION

The invention, in its broadest aspects, comprises an aluminum surface, such as surface 12 on aluminum substrate 10 shown in FIG. 1, having formed thereon a corrosion-resistant protective coating 20 capable of withstanding corrosion attack by process halogen gases and plasmas. The protective coating is formed on the aluminum substrate by first forming an aluminum oxide layer on the aluminum substrate and then contacting the aluminum oxide layer with one or more fluorine-containing gases to form the protective coating thereon.

In a particularly preferred embodiment, the invention comprises an aluminum chamber used in the processing of semi-conductor wafers, such as aluminum reactor chamber 30 shown in FIG. 2, having its inner surfaces 32 protected by a high purity corrosion-resistant protective coating 40 formed thereon capable of withstanding corrosion attack by the aforesaid process halogen gases and plasmas. The high purity protective coating is formed on the aluminum substrate by first forming a high purity aluminum oxide layer on the aluminum substrate and then contacting the high purity aluminum oxide layer with one or more high purity fluorine-containing gases to form the high purity protective coating of the invention thereon.

It should be noted that while the purpose of the invention is to form a protective coating to withstand corrosive attack by process halogen gases and plasmas, reference will be made herein to the corrosion resistance of the coating of the invention when exposed to liquid or aqueous halogen acids because such is considered to be a harsher environment and resistance to such an aqueous halogen environment is, therefore, considered to be a worst case test, as previously alluded to above.

The term "high purity aluminum oxide" as used herein, is meant to define an aluminum oxide having a purity of at least 97 wt. %, preferably greater than 99 wt. %, and in particular having less than 3 wt. %, preferably less than 1 wt. %, of impurities such as, for example, sulfur, boron, and phosphorus and any other elements, including, in general, any other metals and metalloids (including silicon), which could interact with processing materials used in the formation of integrated circuit structures on semi-conductor wafers to introduce undesirable impurities. The aluminum substrate on which such a high purity aluminum oxide is to be formed should have a purity of at least about 99 wt. %, and preferably a purity of about 99.9 wt. %.

The term "aluminum oxide", as used herein, is intended to define both fully dehydrated aluminum oxide, i.e., $A1_2O_3$ (alpha alumina), as well as hydrated forms of aluminum oxide, e.g., $Al(OH)_3$ (bayerite) or AlO(OH) (boehmite).

The term "high purity protective coating" as used herein, is meant to define a high purity aluminum oxide, as defined above, which has been contacted with one or more fluorine-containing gases to form a coating which contains less than about 3 wt. %, and preferably less than about 1 wt. %, of elements other than aluminum, oxygen, hydrogen, and fluorine. By use of the term "concentrated halogen acid" with respect to the concentrated aqueous halogen acids used to evaluate the corrosion resistance of the protective coating of the invention is meant a 35 wt. % or higher concentration of HCl or a 48 wt. % or higher concentration of HF.

a. Formation of Corrosion-Resistant Protective Coating

In either embodiment, to form the corrosion-resistant protective coating of the invention, it is necessary to contact an aluminum oxide film previously formed on the aluminum substrate with one or more fluorine-containing gases. The aluminum oxide film to be contacted by the one or more fluorine-containing gases should have a thickness of from at least about 0.1 micrometers (1000 Angstroms) up to about 20 micrometers (microns) prior to the contacting step. Thicker oxide films or layers can be used, but are not necessary to form the corrosion-resistant protective coating of the invention.

Preferably, the one or more fluorine-containing gases which will be used to contact the previously formed aluminum oxide layer on the aluminum substrate will comprise acid vapors or gases such as gaseous HF or $F_2$, with or without inert carrier gases such as, for example, argon, or neon; or other carrier gases such as hydrogen, oxygen, air, or water vapor, e.g., steam. Examples of other fluorine-containing gases which may be used in the practice of the invention include $NF_3$, $CF_4$, $CHF_3$, and $C_2F_6$.

When a high purity protective coating is to be formed, in accordance with the preferred embodiment of the invention, the reagents used in this step must also be of a sufficient purity so as to not introduce any impurities into the high purity aluminum oxide previously formed on the aluminum substrate. If the fluorine-containing gases, and other gaseous reagents used in this step have a purity of less than about 100 ppm impurities, i.e., have a purity of at least about 99.99 wt. % (usually at least semi-conductor grade), the desired high purity of the protective coating, when such high purity is desired, will be preserved.

The contacting step is preferably carried out in an enclosed reaction chamber, particularly when the high purity protective coating is being formed. However, provided the reaction area is well ventilated, it is within the scope of the invention to contact the aluminum oxide-coated aluminum substrate with one or more fluorine-containing gases in an open area, particularly when the purity of the resultant protective coating is not an issue.

When the protective coating is to be a high purity protective coating for the inner walls of reactors used in the processing of semi-conductor wafers, the aluminum reactor may already be preassembled in which case the oxidized aluminum substrates to be contacted may comprise the inner walls of the aluminum reactor. The aluminum reactor will then additionally serve as the containment vessel for the contacting step as well as providing a high purity environment for the contacting step.

When a containment vessel is used for the contacting step, the one or more fluorine-containing gases may be introduced into the vessel and maintained therein at a concentration ranging from 5 to 100 volume %, depending upon the source of fluorine-containing gas, and a pressure ranging from about 1 Torr to atmospheric pressure.

The contacting step may be carried out for a time period within a range of from about 30 minutes to about 120 minutes at a temperature which may range from about 375° C. to about 500° C., and preferably from about 450° C. to about 475° C. The amount of contact time needed to ensure formation of the protective coating of the invention will vary with the temperature and the concentration of the fluorine-containing gas. Longer periods of time than that specified, however, should not be used if reducing gases (such as $H_2$) are present in the fluorine-containing gas to avoid damage to the underlying oxide layer.

After the contact step, the coated aluminum substrate may be flushed with water or other nonreactive gases or liquids to remove any traces of the fluorine-containing gases. When the contact step is carried out within a closed vessel, wherein the vessel walls comprise oxidized aluminum which has been contacted with the one or more fluorine-containing gases, for example, when forming the high purity protective coating, the reactor vessel may be flushed with non-reactive gases to remove the fluorine-containing gases from the reactor.

The resulting protective coating on the aluminum substrate may then be examined by a number of analytical techniques such as, for example, Auger analysis, SIMS, ESCA LIMS, and EDX and will be found to have a fluorine concentration ranging from 3 to 18 wt. %, based on total weight of the coating.

B. Formation of High Purity Aluminum Oxide Film

To form the high purity protective coating of the invention on the aluminum substrate, e.g., on the inner surfaces of the walls of a reactor used in the processing of semi-conductor wafers, a high purity aluminum oxide film or layer must first be formed on the aluminum substrate. The high purity aluminum oxide layer may be either a thermally formed layer or an anodically formed layer.

However, in either case, to ensure the desired purity, the reagents used in forming the oxide layer should, preferably, be essentially free of impurities which might otherwise be incorporated into the aluminum oxide layer. Therefore, as previously defined with respect to the high purity aluminum oxide coating itself, the reagents used in forming the aluminum oxide coating should preferably have a purity of at least about 97 wt. %, preferably greater than 99 wt. %. In particular, the reagents should preferably have less than 3 wt. %, and more preferably less than 1 wt. %, of impurities such as, for example, sulfur, boron, and phosphorus and any other elements, including, in general, any other metals and metalloids (including silicon), which may be incorporated into the high purity coating and possibly interact with processing materials used in the formation of integrated circuit structures on semi-conductor wafers to introduce undesirable impurities.

It should be noted, however, that the use of reagents which contain impurities that are introduced into the coating may be used in the practice of the invention, even when producing high purity coatings in accordance with the preferred embodiment if the impurity is of a type which may be easily removed from the surface of the coating. For example, if sulfuric acid is used as the electrolyte in forming an anodized aluminum oxide coating, undesirable sulfur in the resultant coating may be removed by thoroughly rinsing the surface with deionized water containing a sufficient amount of nitric acid to adjust the pH to about 5. The nitrate ions apparently exchange with the sulfate ions in the coating and then, due to the solubility of the nitrate ions, are easily removed from the coating as well.

When a high purity thermal oxide layer is to be formed thereon, the aluminum substrate is contacted for a period of from about 10 to about 200 hours with an oxidizing gas at a partial pressure ranging from about 15 wt. % to about 100 wt. % oxygen, with the balance preferably comprising a 99.99 wt. % pure carrier gas. heated to a temperature within a range of from about 350° C. to about 500° C. to form an aluminum oxide coating having a minimum thickness of at least about 1000 Angstroms, preferably about 3000 Angstroms.

To form the high purity aluminum oxide layer anodically, the aluminum substrate is made the anode in an electrolytic cell wherein the electrolyte preferably comprises a compound which will not introduce any other elements into the aluminum oxide coating to be formed anodically on the aluminum substrate, as previously discussed. Preferably, the electrolyte comprises a high purity inorganic acid such as nitric acid or a high purity organic acid such as a monocarboxylic acid, for example, formic acid (HCOOH), acetic acid ($CH_3COOH$), propionic acid ($C_2H_5COOH$), butyric acid ($C_3H_7COOH$), valeric acid ($C_4H_9COOH$), palmitic acid ($CH_3(CH_2)_{14}COOH$), and stearic acid ($CH_3(CH_2)_{16}COOH$); or a dicarboxylic acid, for example, oxalic acid $(COOH)_2$), malonic acid ($CO_2H(CH_2)CO_2H$), succinic acid ($CO_2H(CH_2)_2CO_2H$), glutaric acid ($CO_2H(CH_2)_3CO_2H$), and adipic acid ($CO_2H(CH_2)_4CO_2H$).

Other mineral acids such as sulfuric acid, phosphorus-containing acid, and boronic acid usually should be avoided, when forming a high purity aluminum oxide, because of their tendencies to include in the resulting anodically formed aluminum oxide traces of the respective elements, e.g., sulfur, phosphorus, boron, etc. from the acid electrolyte. However, such mineral acid electrolytes may be used if such impurities can be subsequently removed from the surface of the resulting aluminum oxide coating, as previously discussed.

The anodizing bath may be maintained at a temperature ranging from about 0° C. up to about 30° C. Since the thickness of the anodized film is, at least in part, dependent upon the anodizing voltage, the anodization should be carried out at a voltage within a range of from at least about 15 to about 45 volts D.C. to ensure formation of the desired minimum thickness of anodically formed aluminum oxide, as is well known to those skilled in the art. While conventional DC voltage is preferred, AC voltage may, in some instances, also be utilized.

The anodizing process should be carried out for a time period sufficient to form the desired thickness of aluminum oxide on the aluminum substrate. The progress of the anodic process may be easily monitored by the current flow in the bath. When the current drops below about 10–60 amperes/square foot (indicative of the presence of the insulating aluminum oxide film), the voltage may be shut off and the anodized aluminum may be removed from the bath.

The high purity aluminum oxide coating may also be formed on the aluminum substrate by a combination of thermal and anodic oxide formation, for example, by first anodically forming an oxide coating layer and then thermally oxidizing the anodically formed oxide coating.

After formation of the high purity aluminum oxide film on the aluminum substrate, the aluminum oxide may be contacted, in accordance with the invention, with one or more fluorine-containing gases, as previously described above, to form the high purity corrosion-resistant protective coating of the invention on the aluminum substrate.

The following example will serve to further illustrate the invention:

EXAMPLE

The inner walls of an aluminum reactor suitable for use in the processing of semi-conductor wafers were initially oxidized to form an aluminum oxide layer thereon by anodizing the aluminum reactor surfaces by immersing them in an electrolyte containing 15 wt. % sulfuric acid, with the balance deionized water. The electrolyte was maintained at a temperature of about 13° C. while the aluminum was anodized for about 35 minutes to a final voltage of about 24 volts D.C. and a final current density of 22 amperes/ft.$^2$.

Alternatively, the oxide coating may be formed anodically using a 15 wt. % oxalic acid, balance deionized water electrolyte at 13° C. for 35 minutes to a final voltage of 40 volts and a final current density of about 30 amperes/ft.$^2$; or the oxide coating may be formed thermally in a reactor filled with $O_2$ at a pressure maintained between 500 Torr and atmospheric over a contact period of about 40 hours.

To treat the resultant oxide coating with fluorine gas, in accordance with the invention, a gaseous mixture of 50 vol. % $C_2F_6$ and 50 vol. % $O_2$ was then introduced into the reactor at a pressure of about 10 Torr. The gaseous mixture remained in contact with the reactor walls for about 1 hour while the reactor was maintained at a temperature of about 400° C. The reactor was then flushed with argon gas.

To test the extent of the corrosion resistance of the resulting coating, coated pieces or samples of the coated reactor surfaces were tested with drops of aqueous concentrated (35 wt. %) hydrochloric acid and monitored for the evolution of gas signifying attack or reaction by the acid on the samples. No visible evolution of gas was noted for about 40 minutes.

The reactor was then disassembled and the protective coating which had been formed on the inner walls was examined. No visible signs of corrosion attack on the protective surface were noted. The protective coating on the reactor wall was analyzed for impurities by Auger analysis and found to have less than 3 wt. % of elements other than Al, O, H, and F in the coating layer, indicating the high purity of the protective layer.

Thus, the invention provides a corrosion-resistant protective coating for an aluminum substrate which is capable of protecting the aluminum substrate from corrosive attack by process halogen gases and plasmas. Furthermore, a high purity protective coating may be formed on an aluminum reactor wall suitable for use in the processing of semi-conductor wafers in the construction of integrated circuit structures by first forming a high purity aluminum oxide film and then contacting this film with one or more high purity fluorine-containing gases to form a high purity corrosion-resistant protective film which will not introduce impurities into semi-conductor wafer processes carried out in a reactor protected by such high purity coatings.

Having thus described the invention, what is claimed is:

1. A corrosion-resistant protective coating on an aluminum substrate formed by contacting a high purity aluminum oxide layer on said aluminum substrate having a purity of at least about 97 wt. % aluminum oxide with one or more fluorine-containing gases at an elevated temperature ranging from about 375° C. to about 500° C., said aluminum oxide layer having a minimum thickness of at least about 0.1 micrometers (1000 Angstroms) prior to said contact with said one or more fluorine-containing gases.

2. The corrosion-resistant protective coating on an aluminum substrate of claim 1 wherein said aluminum oxide layer has a thickness ranging from at least about 0.1 micrometers (1000 Angstroms) up to about 20 micrometers (microns) prior to being contacted with said one or more fluorine-containing gases.

3. The corrosion-resistant protective coating on an aluminum substrate of claim 1 wherein said protective coating contains from about 3 wt. % to about 18 wt. % fluorine, based on the total weight of said protective coating.

4. The corrosion-resistant protective coating on an aluminum substrate of claim 1 wherein said one or more fluorine-containing gases are selected from the class consisting of HF, $F_2$, $NF_3$, $CF_4$, $CHF_3$, and $C_2F_6$.

5. The corrosion-resistant protective coating on an aluminum substrate of claim 4 wherein said one or more fluorine-containing gases comprise gaseous HF.

6. The corrosion-resistant protective coating on an aluminum substrate of claim 1 wherein said coating is formed by contacting said aluminum oxide layer with said one or more fluorine-containing gases at an elevated temperature ranging from about 450° C. to about 475° C.

7. The corrosion-resistant protective coating on an aluminum substrate of claim 1 wherein said aluminum oxide layer comprises a thermal oxide layer.

8. The corrosion-resistant protective coating on an aluminum substrate of claim 1 wherein said aluminum oxide layer comprises an anodically formed oxide layer.

9. A high purity corrosion-resistant protective coating on the inner surface of an aluminum reactor constructed of high purity aluminum having a purity of at least 99 wt. %, comprising a high purity aluminum oxide layer on said inner surface of said aluminum reactor having a purity of at least about 97 wt. % aluminum oxide which has been contacted with one or more high purity fluorine-containing gases at an elevated temperature ranging from about 375° C. to about 500° C. to form said high purity aluminum oxide layer having a minimum thickness of at least about 0.1 micrometers (1000 Angstroms) prior to said contact with said one or more high purity fluorine-containing gases.

10. The high purity corrosion-resistant protective coating on said inner surface of said aluminum reactor of claim 9 wherein said high purity aluminum oxide layer has a thickness ranging from at least about 0.1 micrometers (1000 Angstroms) up to about 20 micrometers (microns) prior to being contacted with said one or more high purity fluorine-containing gases.

11. The high purity corrosion-resistant protective coating on said inner surface of said aluminum reactor of claim 9 wherein said high purity protective coating contains from about 3 wt. % to about 18 wt. % fluorine, based on the total weight of said protective coating.

12. The high purity corrosion-resistant protective coating on said inner surface of said aluminum reactor of claim 9 wherein said protective coating contains less than 3 wt. % of elements other than aluminum, hydrogen, oxygen, and fluorine.

13. The high purity corrosion-resistant protective coating on said inner surface of said aluminum reactor of claim 9 wherein said protective coating contains less than 1 wt. % of elements other than aluminum, hydrogen, oxygen, and fluorine.

14. The high purity corrosion-resistant protective coating on said inner surface of said aluminum reactor of claim 9 wherein said one or more high purity fluorine-containing gases have a purity of less than about 100 ppm impurities therein.

15. The high purity corrosion-resistant protective coating on said inner surface of said aluminum reactor of claim 14 wherein said one or more high purity fluorine-containing gases are selected from the class consisting of HF, $F_2$, $NF_3$, $CF_4$, $CHF_3$, and $C_2F_6$.

16. The high purity corrosion-resistant protective coating on said inner surface of said aluminum reactor of claim 15 wherein said one or more high purity fluorine-containing gases comprise gaseous high purity HF.

17. A high purity corrosion-resistant protective coating, having less than about 3 wt. % of elements other than aluminum, oxygen, hydrogen, and fluorine, on the inner surface of an aluminum reactor formed from high purity aluminum having a purity of 99 wt. % or higher comprising a 97 wt. % or higher purity aluminum oxide layer formed on the inner surface of said aluminum reactor which has been contacted with one or more high purity fluorine-containing gases containing less than 100 ppm impurities at a temperature of from about 375° C. to about 500° C. to form said high purity corrosion resistant protective coating thereon, said high purity aluminum oxide layer having a minimum thickness of at least about 0.1 micrometers (1000 Angstroms) prior to said contact with said one or more high purity fluorine-containing gases.

18. An aluminum reactor suitable for use in the processing of semiconductor wafers and characterized by a high purity corrosion-resistant protective coating on the inner aluminum surface of the reactor capable of withstanding corrosion attack by process halogen gases and plasmas comprising a high purity aluminum oxide layer on said aluminum substrates having a purity of at least about 97 wt. % aluminum oxide which has been contacted with one or more high purity fluorine-containing gases at an elevated temperature to form said high purity corrosion resistant protective coating thereon.

19. An aluminum reactor suitable for use in the processing of semiconductor wafers formed from high purity aluminum having a purity of at least 99.9 wt. % and characterized by a high purity corrosion-resistant protective coating on the inner aluminum surfaces of the reactor capable of withstanding corrosion attack by process halogen gases and plasmas comprising a high purity aluminum oxide layer on said inner aluminum surfaces having a purity of at least about 97 wt. % aluminum oxide which has been contacted with one or more high purity fluorine-containing gases at an elevated temperature of from about 450° C. to about 475° C. to form said high purity corrosion resistant protective coating thereon, said high purity aluminum oxide layer having a minimum thickness of at least about 0.1 micrometers (1000 Angstroms) prior to said contact with said one or more high purity fluorine-containing gases.

20. The aluminum reactor of claim 19 wherein said high purity aluminum oxide layer has a purity of at least about 99 wt. % aluminum oxide.

* * * * *